US008287175B2

(12) United States Patent
Zimmerman et al.

(10) Patent No.: US 8,287,175 B2
(45) Date of Patent: Oct. 16, 2012

(54) BUBBLE GENERATION FOR AERATION AND OTHER PURPOSES

(75) Inventors: William Bauer Jay Zimmerman, Sheffield (GB); Vaclav Tesar, Jinzo Mesto (CZ)

(73) Assignee: Perlemax Limited, Sheffield (GB)

( * ) Notice: Subject to any disclaimer, the term of this patent is extended or adjusted under 35 U.S.C. 154(b) by 637 days.

(21) Appl. No.: 12/447,629

(22) PCT Filed: Oct. 29, 2007

(86) PCT No.: PCT/GB2007/004101

§ 371 (c)(1),
(2), (4) Date: Apr. 28, 2009

(87) PCT Pub. No.: WO2008/053174

PCT Pub. Date: May 8, 2008

(65) Prior Publication Data

US 2010/0002534 A1 Jan. 7, 2010

(30) Foreign Application Priority Data

Oct. 30, 2006 (GB) ..... 0621561.0

(51) Int. Cl.
*B01F 3/04* (2006.01)

(52) U.S. Cl. ..... 366/106; 366/107; 137/561 A

(58) Field of Classification Search ..... 366/106, 366/107; 422/305; 406/137; 261/78.2, 69.1; 137/561 A See application file for complete search history.

(56) References Cited

U.S. PATENT DOCUMENTS

| | | | | |
|---|---|---|---|---|
| 4,167,873 | A * | 9/1979 | Bahrton | 73/861.19 |
| 4,793,714 | A | 12/1988 | Gruber | |
| 5,190,099 | A * | 3/1993 | Mon | 165/104.33 |
| 5,524,660 | A | 6/1996 | Dugan | |
| 5,674,433 | A * | 10/1997 | Semmens et al. | 261/37 |
| 5,893,383 | A * | 4/1999 | Facteau | 137/14 |
| 6,572,084 | B1 * | 6/2003 | Ivanovich et al. | 261/64.1 |
| 6,805,164 | B2 * | 10/2004 | Stouffer | 137/833 |
| 7,128,082 | B1 * | 10/2006 | Cerretelli et al. | 137/14 |

FOREIGN PATENT DOCUMENTS

AU 2007315935 A1 5/2008

(Continued)

OTHER PUBLICATIONS

International Search Report of corresponding PCT/GB2007/004101 application.

(Continued)

*Primary Examiner* — Yogendra Gupta
*Assistant Examiner* — Emmanuel S Luk
(74) *Attorney, Agent, or Firm* — Alston & Bird LLP

(57) ABSTRACT

A method of producing small bubbles (90) of gas in a liquid comprises a source (16) of the gas under pressure, a conduit (64*a*) opening into a liquid and oscillating the gas passing along the conduit at a frequency between 1 and 100 Hz. The oscillation is effected by fluidic oscillator (10) comprising a diverter that divides the supply into respect outputs (A, B), each output being controlled by a control port, wherein the control ports are interconnected by a closed loop (22). There may be at least two of said conduits (62*a*, 64*a*), each output port being connected to one or the other of said conduits, in which one phase of the oscillating gas is employed to drive liquid across the conduit (64*a*) after formation of a bubble in the other phase of oscillation, whereby the bubble is detached by the force of said driven liquid.

22 Claims, 7 Drawing Sheets

FOREIGN PATENT DOCUMENTS

| | | | |
|---|---|---|---|
| DE | 3543022 | C1 | 8/1987 |
| DE | 44 05 961 | A1 | 8/1995 |
| DE | 195 30 625 | A1 | 2/1997 |
| EP | 0 135 822 | A | 4/1985 |
| EP | 0251627 | A1 | 1/1988 |
| EP | 0 376 008 | A | 7/1990 |
| EP | 1 092 541 | A2 | 4/2001 |
| GB | 1 281 630 | | 7/1972 |
| GB | 2 273 700 | A | 6/1994 |
| GB | 2443396 | A | 5/2008 |
| JP | 60156536 | A | 8/1985 |
| JP | 62277133 | A | 12/1987 |
| JP | 63028432 | A | 2/1988 |
| JP | 2002126482 | A | 5/2002 |
| JP | 2003/265939 | A | 9/2003 |
| JP | 2006087984 | | 4/2006 |
| JP | 2008036502 | | 2/2008 |
| JP | 2009535112 | A | 10/2009 |
| SU | 1057436 | A | 11/1983 |
| SU | 1333653 | A1 | 8/1987 |
| SU | 161561 | A1 | 12/1990 |
| WO | WO 99/30812 | | 6/1999 |
| WO | WO 99/31019 | | 6/1999 |
| WO | WO 2007/127596 | A1 | 11/2007 |

OTHER PUBLICATIONS

Australian Office Action dated Aug. 15, 2011, for Application No. 2007315935.
European Office Action dated Feb. 9, 2010, for Application No. 07824345.8.
Japan Office Action dated Apr. 15, 2011, for Application No. 2009-535112.
Japan Patent Office Search Report dated Mar. 30, 2012, for Application No. 2009-535112.
United Kingdom Examination Report dated Jul. 26, 2010, for Application No. GB0621561.0.
United Kingdom Examination Report dated Jun. 15, 2011, for Application No. GB0621561.0.
United Kingdom Examination Report dated Aug. 9, 2011, for Application No. GB0621561.0.
United Kingdom Search Report on Claims 1-9, 30-36, and 39 dated Feb. 21, 2007, for Application No. GB0621561.0.
United Kingdom Search Report on Claims 10-22, 37 and 39 dated May 17, 2007, for Application No. GB0621561.0.
United Kingdom Search Report on Claims 38 and 39 dated May 17, 2007, for Application No. GB0621561.0.
United Kingdom Search Report on Claims 23-29 and 39 dated May 17, 2007, for Application No. GB0621561.0.
International Preliminary Report on Patentability, dated May 5, 2009, of corresponding PCT/GB2007/004101 application.

* cited by examiner

BUBBLE GENERATION FOR AERATION AND OTHER PURPOSES

This invention relates to the generation of fine bubbles.

BACKGROUND

Bubbles of gas in liquid are frequently required in many different applications and usually, but not exclusively, for the purpose of dissolving the gas in the liquid. Like any industrial process, it is generally desired that this be done in the most efficient manner possible which, in the case of dissolving the gas in the liquid, does not involve the bubble reaching the surface of the liquid and releasing the gas there without it having been dissolved. Ideally, the bubbles should not reach the surface before all the gas in them has dissolved. It is widely recognised that one way to achieve efficiency is to reduce the size of the bubbles. The surface area to volume ratio of a smaller bubble is higher, and dissolution happens much more rapidly. Moreover, the surface tension of a small bubble means that the gas pressure inside the bubble is relatively much higher than in a large bubble, so that the gas dissolves more rapidly. Also small bubbles rise more slowly than large bubbles, and this provides more time for gas transport from the bubble to the surrounding liquid. Furthermore, they coalesce less quickly so that larger bubbles, that rise to the surface faster, are less quickly formed.

Applications that do not involve gas dissolution apply in oil wells where bubbles rising can transport oil to the surface in certain types of well. Here small bubbles are also advantageous because it takes them longer to coalesce and form the big slugs of gas that are not effective in raising oil.

The corollary problem connected with fine bubbles, however, is that they are harder to produce. Reducing the size of the aperture through which the bubble is injected into the liquid is a first step, since it is difficult to form small bubbles through a large aperture. But, even so, a bubble may reach a large size by growing while attached even to a small gas-supplying aperture. Bubble separation is a dynamic process. In any event, such reduction in aperture size is not without cost, because the friction resisting flow of the gas through such a fine aperture, and through the passage leading to the aperture, means that a greater pressure drop is required. The bubble forms once the size of the bubble goes beyond hemispherical and necking-off of the bubble can occur. However, more energy needs to be applied at this stage to finally detach the bubble and generally this is simply achieved by pressing more gas into it increasing its size.

Indeed, generally, bubbles can be no smaller in diameter than the diameter of the aperture through which they are injected, and reducing the size of the bubble increases the energy needed to produce them so that a limit is reached beyond which the efficiency of the system is not improved any further.

A further problem is that, as bubbles grow beyond hemispherical, the pressure inside them drops. Consequently, two or more bubbles grown in parallel from a common source tend to be unstable beyond hemispherical. What occurs is that, beyond the hemispherical stage, one bubble grows rather more rapidly than an adjacent one (for any of a number of reasons, eg perhaps one is closer to the pressure source and so there is correspondingly less drag and greater pressure to drive the bubble formation). Once there is a size differential there is also a pressure differential with the greater pressure being in the smaller bubble. Consequently, since the bubbles are connected, the smaller bubble inflates the larger one at the expense of its own growth. The result is that, where multiple conduits are connected to a common pressure source, only a few of them end up producing overly large bubbles.

This instability of bubble formation may lead to one of the bubbles growing out of proportion to the aperture size. The necking-off and separation is a dynamic phenomenon and if the unstable bubble grows fast, it may reach a big size before it separates.

Another problem with uncontrolled bubble formation is that colliding bubbles frequently coalesce, so that the extra effort of forming small bubbles is immediately wasted. Ideally, monodisperse bubbles should be provided with sufficient gap between them to prevent coalescing. Indeed, the conditions that lead to coalescing may be dependent on a number of factors connected with a particular site and application, and that, desirably tuning of a bubble generation system should be possible so that the most efficient bubble generation can be arranged.

WO99/31019 and WO99/30812 both solve the problem of fine bubble generation using relatively large apertures by injecting the gas into a stream of the liquid being driven through a small aperture directly in front of the gas exit aperture. The stream of liquid draws the gas into a fine stream, much narrower than the exit aperture for the gas, and fine bubbles ultimately form beyond the small aperture. However, the physical arrangement is quite complex, although bubbles of 0.1 to 100 microns are said to be produced. Furthermore, although the gas exit aperture is large, the liquid into which the gas is injected is necessarily under pressure to drive it through the small aperture which therefore implies that the gas pressure is necessarily also higher, which must mitigate some of the advantage.

Numerous publications recognise that vibration can assist detachment of a bubble or, in the case of EP1092541, a liquid drop. That patent suggests oscillating one side of an annular discharge orifice. The production of liquid drops in a gas matrix can sometimes be regarded as a similar problem to the production of gas bubbles in a liquid matrix.

SU1616561 is concerned with aeration of a fish tank which comprises forcing air through a pipe where apertures open between flaps that vibrate under the influence of the gas motion and produce fine bubbles.

GB1281630 employs a similar arrangement, but also relies on the resonance of a cavity associated with a steel flap to increase frequency of oscillation of the flap and thereby further reduce the size of the bubbles.

U.S. Pat. No. 4,793,714 pressurises the far side of a perforated membrane through which the gas is forced into the liquid, the membrane being vibrated whereby smaller bubbles are produced.

U.S. Pat. No. 5,674,433 employs a different tack by stripping bubbles from hydrophobic hollow fibre membranes using volume flow of water over the fibres.

GB2273700 discloses an arrangement in which sonic vibrations are applied to the air in a sewage aeration device comprising a porous "organ pipe" arrangement, in which the pipe is vibrated sonically by the air flow. The invention relies on vibration of the aerator by virtue of the organ pipe arrangement, losing much of the energy input through inevitable damping by the surrounding water.

DE4405961 also vibrates the air in an aeration device for sewage treatment by mounting a motor driving the air pump on the aeration grid employed, and so that the grid vibrates with the natural vibration of the motor and smaller bubbles result. DE19530625 shows a similar arrangement, other than that the grid is oscillated by a reciprocating arrangement.

JP2003-265939 suggests ultrasonically vibrating the surface of a porous substrate through which a gas is passed into a liquid flowing over the surface.

From the above it is apparent that small bubble generation has application in the sewage treatment industry, in which it is desired to dissolve oxygen in the water being treated. This is to supply respiring bacteria that are digesting the sewage. The more oxygen they have, the more efficient the digestion process. However, a similar requirement exists in bioreactors and fermenters generally where they are sparged for aeration purposes. Specifically, the yeast manufacturing industry has this requirement, where growing and reproducing yeast bacteria needs constant oxygen replenishment for respiration purposes. Another application is in the carbonisation of beverages, where it is desired to dissolve carbon dioxide into the beverage. A process not looking to dissolve the gas but nevertheless benefiting from small bubbles is in the extraction of hard-to-lift oil reserves in some fields which either have little oil left, or have the oil locked in sand. Indeed, much of the oil in Canada's oil reserves is in the form of oil sand. Bubbling gas up through such oil-bearing reserves has the effect of lifting the oil as the bubbles rise under gravity and bring the oil with them. The bubbles are formed in water and pumped into the well or reserve and the oil is carried at the interface between the gas and water of each bubble as it passes through the reserves. The smaller the bubble, the greater the relative surface area for transport of the oil.

It is an object of the present invention to improve upon the prior art arrangements.

BRIEF SUMMARY OF THE DISCLOSURE

In accordance with the broadest aspect of the present invention there is provided a method of producing small bubbles of gas in a liquid comprising the steps of:

providing a source of the gas under pressure;

providing a conduit opening into a liquid under pressure less than said gas, said gas being in said conduit; and oscillating the gas passing along said conduit without oscillating the conduit, other than by any reaction of the oscillating gas, said oscillation being at a frequency between 1 and 100 Hz.

Thus the entire energy of the system is in oscillating the gas, and not the conduit through which it is passed, whereby the efficiency of the system can be maximised. Energy is not wasted in oscillating the conduit that will have a much greater mass and consequently will require more energy to oscillate. Despite any resonance, friction still accounts for a proportion of the energy employed. In the case of DE4405961, which uses "waste" vibration of the motor and compressor of an aeration system, the motor and compressor, as a result, must be mounted under water on the aeration grid.

Sonic and ultrasonic vibrations as suggested in GB2273700 and JP2003-265939 respectively are high frequency and may not be as effective in generating bubbles. Although high energies can be imparted, the most effective detachment of bubbles is with longer stroke (higher amplitude) oscillations, rather than higher frequencies.

In accordance with another aspect of the present invention there is provided a method of producing small bubbles of gas in a liquid comprising the steps of:

providing a source of the gas under pressure;

providing a conduit opening into a liquid under pressure less than said gas, said gas being in said conduit; and oscillating the gas passing along said conduit without oscillating the conduit, other than by any reaction of the oscillating gas, said oscillation being effected by a fluidic oscillator.

Preferably, said first and second aspects of the present invention are combined, wherein said oscillations effected by the fluidic oscillator are effected at said frequency between 1 and 100 Hz, preferably between 5 and 50 Hz, more preferably between 10 and 30 Hz.

Preferably, the bubbles formed are between 0.03 and 2 mm in diameter, more preferably between 0.05 and 0.1 mm.

Preferably, said oscillation is of the type that has less than 30% backflow of gas from an emerging bubble. Indeed, said oscillation preferably is of the type that has between 0% and 20% backflow of gas from an emerging bubble. This is preferably provided by an arrangement in which a fluidic oscillator divides flow between two paths, at least one of said paths forming said source. In this case, flow is primarily only in the forwards direction with flow ceasing periodically in a square wave form with the base of the square wave being essentially no-flow.

Backflow here means that, of a net gas flow rate from said conduit of x $m^3s^{-1}$, (x+y) $m^3s^{-1}$ is in the positive direction while (−y) $m^3s^{-1}$ is in the negative direction, 100(y/(y+x)) being defined as the percentage backflow. Some backflow is largely inevitable, particularly with the arrangement where flow splits between paths, since there will always be some rebound. Indeed, such is also a tendency with bubble generation since, with the removal of pressure, back pressure inside the bubble will tend to cause some backflow. Indeed, backflow here means at the conduit opening, because backflow may vary by virtue of the compressibility of the gas.

Preferably, the fluidic oscillator comprises a diverter supplied with the gas under constant pressure through a supply port that divides into respect output ports, and including means to oscillate flow from one output port to the other. Preferably, said means comprises each output port being controlled by respective control ports. Preferably, the control ports are interconnected by a closed control loop. Alternatively, a branch of each output port may supply each respective control port, whereby part of the flow in an output port becomes a control flow, switching the supply flow from that output port to the other output port.

When a control loop is employed, the control ports are arranged so that each has reduced pressure when the gas flows through its respective output, and increased pressure when there is no flow through its respective output. Consequently, when gas flows out of a control port, it detaches the main supply flow of the gas from the wall in which said control port is formed and switches that flow from the output port associated with that wall to the other output port, attaching the main flow from supply port to the wall associated with the other control port, and so the situation reverses with the main flow from the supply port oscillating between said output ports with a frequency determined by a number of factors including the length of the control loop.

Preferably, there are at least two of said conduits, each output port being connected to one or the other of said conduits.

The frequency of the oscillations may be adjusted by changing the length of said closed loop.

Preferably, the volume flow of said oscillating gas is sufficient that a plurality of said conduits may be supplied simultaneously. Preferably, the volumetric flow rate for each cycle of oscillation is sufficient to fill a bubble at each conduit to at least hemispherical size before the oscillation is switched, so that all the bubbles have substantially the same size before being separated from the conduit by the break in pressure.

Without wishing to be bound by any particular theory, it is believed that initial growth of a bubble from flat across the mouth of the conduit towards hemispherical accelerates and gives momentum to the liquid being displaced away from the mouth. Normally, as more gas is supplied, the bubble simply grows and the momentum of the retreating liquid continues, albeit decelerating, since the rate of growth of bubble radius is proportional to the cubed root of the volume of gas in the bubble. However, if the supply of gas to the bubble is cut off suddenly, a dynamic separation regime is observed whereby the bubble is "torn-off" the conduit. The bubble therefore forms at a much smaller size than would otherwise occur with a steady state fill pressure.

Preferably, the conduit opens in the liquid at a surface of the material in which the conduit is formed, said surface being in a plane which is substantially vertical with respect to gravity. It is found that the tendency of the bubble to rise transversely with respect to the conduit by virtue of the disposition of the material surface surrounding the conduit serves to cause a pinching-off effect as the bubble rebounds at the end of each oscillation. Indeed, in one experiment, where the surface containing the conduit was horizontal, bubbles of diameter 500 microns in diameter were produced and yet, by turning the surface through 90 degrees with all other things being equal, bubbles of diameter one tenth of that were achieved.

Preferably, said conduit comprises a membrane having a slit which is closed, gas pressure behind the membrane serving to distend the slit to permit a bubble of gas to form through the slit, the slit closing behind the bubble, wherein the oscillation of the gas flow is synchronised in terms of pressure, flow rate, amplitude and frequency with the elastic properties of the membrane to encourage small bubble formation. In this respect, with a constant gas pressure, the mode of operation of such a membrane diffuser is oscillatory and consequently the oscillations of the gas can be synchronised so that, as the pressure behind the slit drops, sufficient gas has already exited the slit that the bubble cannot be squeezed back through the slit by its own surface tension before the slit closes.

In this respect, the material of the surface through which the conduit is formed is preferably non-wettable by the gas, so that the bubble does not tend to stick to it. Glass is a suitable material in this respect, although other materials such as Teflon® are also suitable.

The invention permits retrofitting in existing installations that comprise a supply of gas under pressure and one or more bubble generators supplied by said supply and comprising a plurality of conduits opening into the liquid. In this event, the gas oscillator is interposed between the supply and bubble generator. Preferably, said bubble generator comprises a chamber connected to said gas supply and a porous wall of said chamber separating said chamber from the liquid and comprising said plurality of conduits. Said conduits may be apertures formed in said wall. The wall may be metal, for example sintered metal in which said conduits are pores in said metal. Alternatively, the wall may be a porous ceramic and the conduits being the pores of said ceramic.

A third aspect of the present invention provides an alternative arrangement, which may be particularly preferred where very small bubbles are desired of very even size distribution, one phase of the oscillating gas is employed to drive liquid across the conduit after formation of a bubble in the other phase of oscillation, whereby the bubble is detached by the force of said driven liquid. Preferably, this is provided by the arrangement described above in relation to the diverter where the conduits of each output are arranged facing one another at an inclined angle, preferably at right angles, with respect to one another, one output being maintained filled with the liquid. Thus, while the first output fills a bubble at the mouth of its conduit, on the second phase, liquid is driven out of the other conduit knocking off the bubble formed on the first conduit. The arrangement is especially suitable when a plurality of conduits, that is gas conduits, are supplied in parallel from one output, a similar plurality of conduits, that is, liquid conduits, being disposed opposite the gas conduits and supplied in parallel by the other output. The bubbles on the gas conduits will all be stably formed of approximately equal size provided they do not much exceed hemispherical in size, and can be knocked off sooner than would be the case without the impetus of the liquid driven by the liquid conduits. Such an arrangement is conveniently referred to as a knock-off system, as the bubbles are knocked off their attachment to the aperture forming them.

A suitable arrangement comprises a plate having two parallel manifolds parallel a surface of the plate in contact with the liquid and supplied by respective outputs of the diverter, a trench in the surface and disposed between and parallel the manifolds, and conduits leading from opposed sides of the trench into said manifolds. Preferably, the trench is V-shaped. Preferably, the V-shaped trench is right-angled.

Preferably, the output of the diverter feeding the manifold supplying the liquid conduits is provided with a gas bleed-valve whereby the liquid conduits fill with the liquid.

Thus, with a given fluidic oscillator, whose flow rate and oscillation frequency are easily adjustable on-site, the most ideal arrangement of bubble generation (ie size and distribution) can be tuned for the particular circumstances whereby the most appropriate size and spatial distribution of bubbles can be adjusted.

In theory, the viscosity of liquid should not affect the process of bubble formation, but when the knock-off system is applied in more viscous liquids a different mechanism can be observed and which possibly may also be applicable in lower viscosity liquids, although, with the higher frequency of operation of low-viscosity liquids, it might not be so easily observed. Indeed, a fourth aspect of the present invention is directed to this alternative arrangement and which may also explain the functioning of the first aspect of the present invention.

In accordance with this fourth aspect of the present invention, there is provided a method of producing small bubbles of gas in a liquid comprising the steps of:

providing a source of the gas under pressure;

providing a conduit opening into a liquid under pressure less than said gas through a plurality of openings of the conduit, said openings having an open end and an end in contact with the conduit, said gas being in said conduit; and oscillating the gas passing along said conduit so that liquid is drawn into the conduit through at least one of said openings and forms a plug of liquid in the conduit pushed along said conduit by the gas so that, when said plug reaches others of said openings, the gas is pushed out of said openings by the liquid plug thereby forming a bubble when said plug reaches the open end of said openings.

Thus, in this event, bubbles are neither knocked off by a flow of liquid transverse to the openings nor pinched off by the inertia of liquid ahead of the forming bubble. Instead they are pushed off by the plug of liquid detaching the bubble from behind. On the other hand, there is nothing to suggest that the knock-off and/or pinch-off mechanisms described above may not also be contributing to the detachment of the bubbles, as well as this push-off mechanism.

BRIEF DESCRIPTION OF THE DRAWINGS

Embodiments of the invention are further described hereinafter, by way of example, with reference to the accompanying drawings, in which.

DETAILED DESCRIPTION

Figure 1:
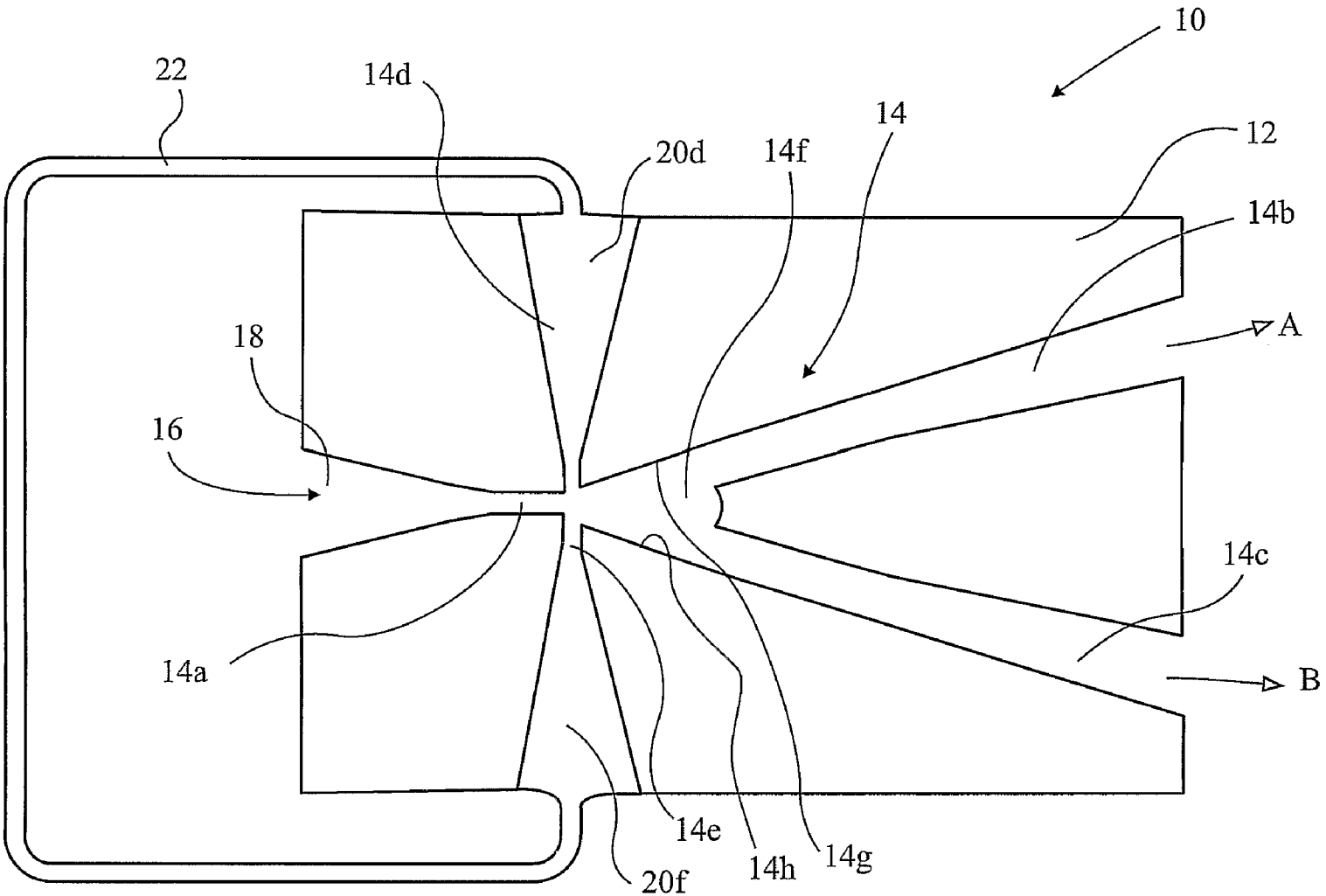
FIG. 1 is a plan view of a suitable diverter to oscillate gas in a method in accordance with the present invention.

In FIG. 1 a fluidic diverter 10 is shown in section, comprising a block 12 in which passages indicated generally at 14 are formed. An inlet passage 14*a* has a supply 16 of fluid under pressure connected thereto by an inlet port 18. Two outlet passages 14*b,c* branch from the inlet passage 14*a*. Two control passages 14*d,e* oppose one another on either side of the inlet passage just in front of the branch 14*f* between the two outlet passages 14*b,c*. The control passages are supplied by control ports 20*d,f* which are interconnected by a closed loop conduit 22. When fluid passes along the inlet passage 14*a* and enters the diverging branch 14*f* it tends to cling to one side or the other under the influence of the Coanda effect, and preferentially enters one or other of the outlet passages 14*b,c*. In fact, the effect is so strong that, provided the pressure region upstream of the outlet passages 14*b,c* is favourable, more than 90% of flow in the inlet passage 14*a* will enter one or other of the outlet passages 14*b,c*. The outlet passages 14*b,c* are connected to respective outlet ports A,B.

If the flow is predominantly into outlet passage 14*b*, for example, then the flow of fluid follows closely wall 14*g* of the inlet passage 14*a* and across the mouth of control passage 14*d*, reducing the pressure in the passage accordingly by virtue of the venturi effect. Conversely, there is not so much flow adjacent control passage 14*e*. Consequently, a pressure difference is created in the control loop 22 and fluid flows from control port 20*f*, around control loop 22, and enters control port 20*d*. Eventually, the flow out of the control passage 14*d* becomes so strong that the flow from inlet passage 14*a* to outlet passage 14*b* detaches from the wall 14*g* containing the mouth of control passage 14*d*, and instead attaches on the opposite wall 14*h*, whereupon such flow is switched to passage 14*c*. Then, the opposite condition pertains, and the pressure in control port 14*e* is reduced, and grows in control port 14*d*, whereupon the flow in control loop 22 reverses also. The arrangement therefore oscillates, in known manner, dependent on several factors including the length of loop 22, which length affects the inertia of the control flow and the speed with which it switches. Other factors including the geometry of the system, back pressure from the outlets and the flow through the diverter 10 also affect the frequency.

The arrangement shown in FIG. 1 conveniently comprises a stack of several Perspex™ plates each about 1.2 mm thick and laser cut with the outline shape of passage 14. Top and bottom cover plates close and complete passage 14 and hold the stack together, the bottom (or top) one being provided with the ports 18, 20*d*, 20*f*, A, and B. However, it has been shown experimentally that the arrangement scales up effectively and is within the ambit of the person skilled in the art.

Figure 2:
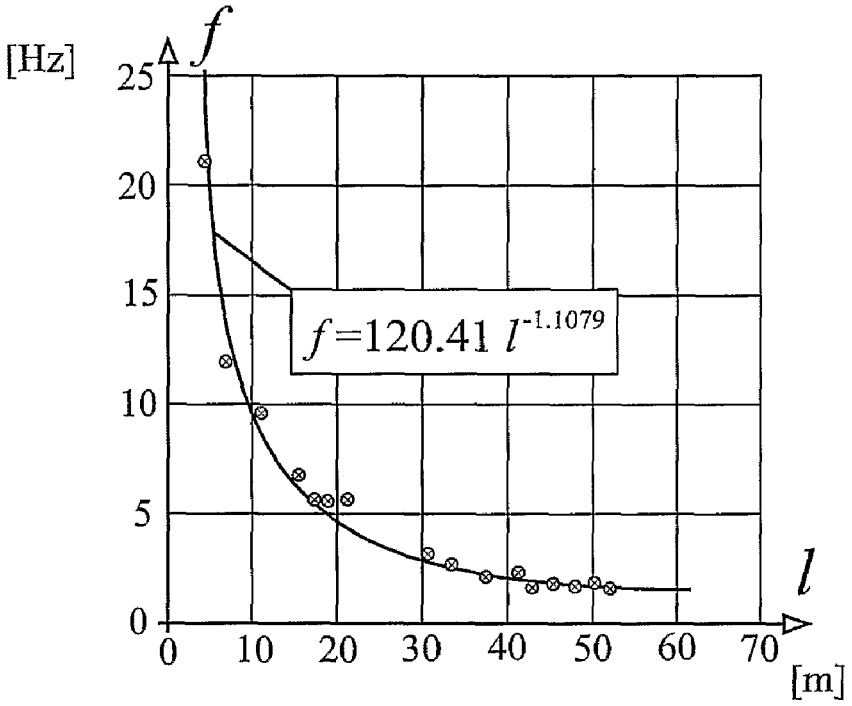
FIG. 2 is a graph of oscillation frequency plotted against feedback loop length for one arrangement of the diverter shown in FIG. 1.

FIG. 2 illustrates the variation of frequency of oscillation of one system employing air as the fluid in the diverter of FIG. 1, with a control loop of plastics material of 10 mm internal diameter and an airflow of 10 litres per minute. Frequencies between 5 and 25 Hz are easily achieved. Again, the arrangement is capable of being scaled-up to provide significant airflows in this range of oscillation frequency.

Figure 7:
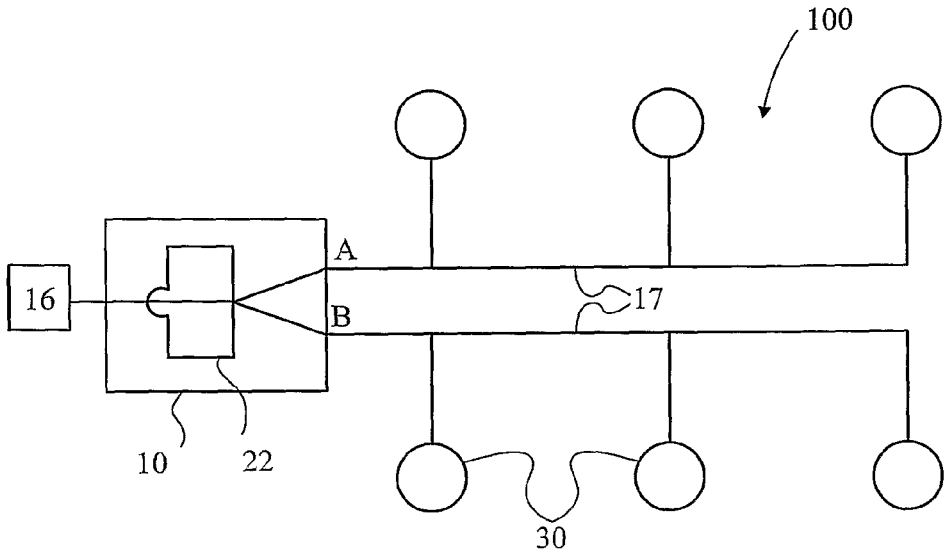
FIG. 7 is a schematic illustration of the overall arrangement of a preferred embodiment of the present invention.

When the outputs A,B of diverter 10 are connected to bubble diffusers 30 in an arrangement 100 such as illustrated schematically in FIG. 7, finer bubbles are produced than when a steady flow rate of similar magnitude is employed. Several diffusers 30 are connected in parallel to each outlet port A,B by appropriate tubing 17. Moreover, because the bubbles are finer, fewer large bubbles are produced: they are detached sooner by virtue of the oscillating air supply.

Figure 8:
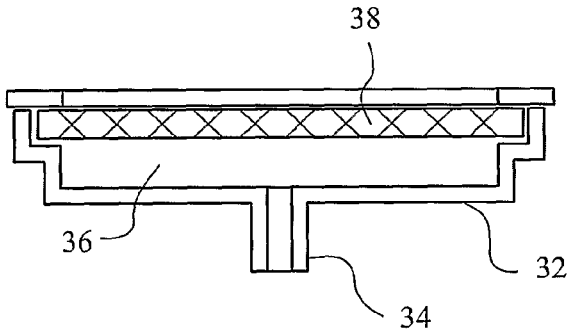
FIG. 8 is a cross section through a bubble generator of the system of FIG. 7.

A suitable diffuser 30 is shown in FIG. 8, which comprises a housing 32 of shallow, hollow cylindrical form and having a central inlet opening 34 for connection to the tubing 17. The chamber 36 formed by the housing 32 is closed by a porous disc 38, which may be ceramic, or a sintered metal. Such bubble diffusers are known and in use in the water treatment industry, and such products are available, for example, from Diffuser Express, a division of Environmental Dynamics Inc of Columbia, Mo., USA.

Indeed, as regards FIG. 7, the only part not already employed in the present sewage treatment industry is the diverter 10, and the arrangement of the present invention provides the opportunity for retrofitting the method of the invention into existing installations, simply by interposing a diverter 10 of appropriate size and configuration into the supply to an existing network of diffusers 30. Other forms of diffuser do, of course, exist and are applicable to the present invention.

While described above with reference to sewage treatment, as mentioned above, the present invention may have application in numerous other fields in which a gas needs diffusing into a liquid. In the sewage treatment regime, other than in the search for efficiency, the equality of the bubble size or their absolute minimisation in size may not be imperative. Rather, the capacity to retro-fit the arrangement may be more important. However, in new installations, or in other applications where, for particular reasons, a very small bubble size, and very even bubble size distribution, is desired, the arrangement illustrated in FIGS. 4 and 5 may be employed.

Figure 3:
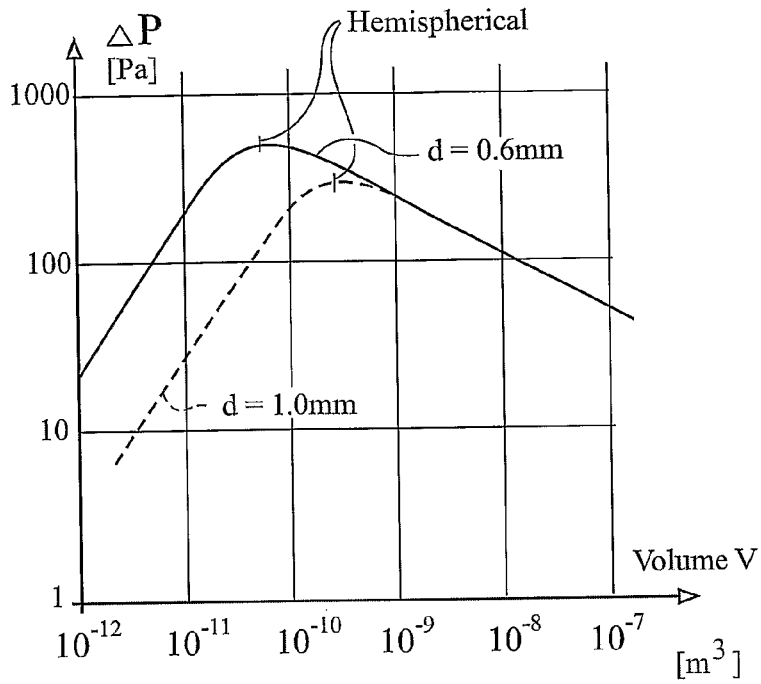
FIG. 3 is a graph of bubble pressure against bubble volume for conduit openings of two different diameters.

Referring first to FIG. 3, two plots are shown of internal pressure against bubble size being formed from two apertures of different size (0.6 and 1.0 mm). The pressure increases substantially linearly with increasing volume until the bubble reaches a hemispherical shape. Thereafter, however, pressure decreases as the bubble grows further. Thus, at any given pressure, a bubble can have two sizes. More importantly, however, if two bubbles are growing from two ports that are supplied by a common source in parallel with one another then as the pressure increases with growing bubble size, the growth of the two bubbles in parallel is stable. However, once the bubble reaches hemispherical the stable growth ends and as one bubble continues to grow its pressure diminishes. Consequently, if there should be any imbalance between the growth of the two bubbles so that one reaches hemispherical and beyond first, the pressure in the one whose growth is slower will be higher, rather than lower, than the bubble whose growth is faster. Consequently, what occurs is that faster growing bubbles grow larger and slower growing bubbles are smaller and may never detach.

Figure 4:
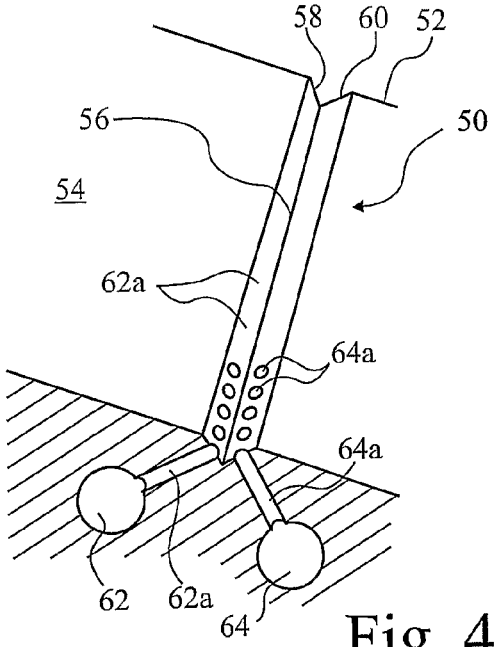
FIG. 4 is a bubble generator plate of an alternative arrangement of the present invention.
Figure 5:
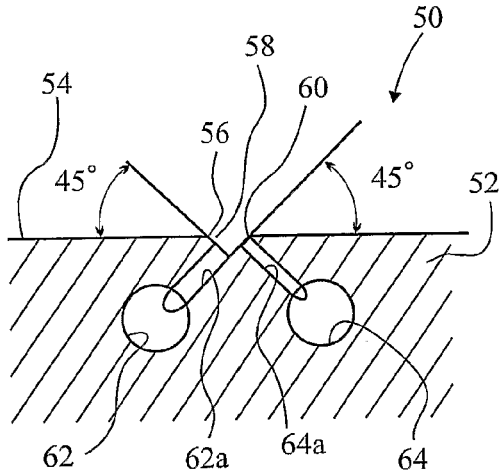
FIG. 5 is an end view showing the relative dimensions of the liquid and gas conduits of the bubble plate shown in FIG. 4.

In FIGS. 4 and 5, a diffuser 50 comprises a plate 52 having a top surface 54 in which a right-angled groove 56 is formed, with each of its sides 58,60 being angled at 45° to the top surface 54. Under the surface but parallel thereto are two supply passages 62,64 also lying parallel, and disposed one on either side of, the groove 56. Rising up from each passage are a plurality of ports 62*a*,64*a*. Ports 64*a* are relatively narrow and open in the middle of the face 60 of the groove 56. Ports 62*a* are relatively broad and open at the base of the groove 56. There are as many ports 62*a* as there are ports 64*a*, and each port 62*a* is arranged opposite a corresponding port 64*a*. Moreover, the passage 62 and the ports 62*a* are arranged so that the direction of discharge of fluid from port 62*a* is parallel the face 60 of the groove 56.

Passage 62 may be larger than passage 64, but the ports 62*a* are certainly larger than the ports 62*b*. The reason for this is that the passage 62 is arranged to carry liquid, the liquid in which the diffuser 50 is sited. The passage 64, on the other hand, carries gas. The arrangement is such that the diameter of the gas port 62*b* is small, according to the desired size of bubble to be formed, and possibly as small as 0.5 mm or less depending on the technique employed to form the port 64*a*. In Perspex™-type material, the holes can be drilled mechanically to about 0.5 mm, but other methods exist to make smaller holes if desired.

Figure 6:
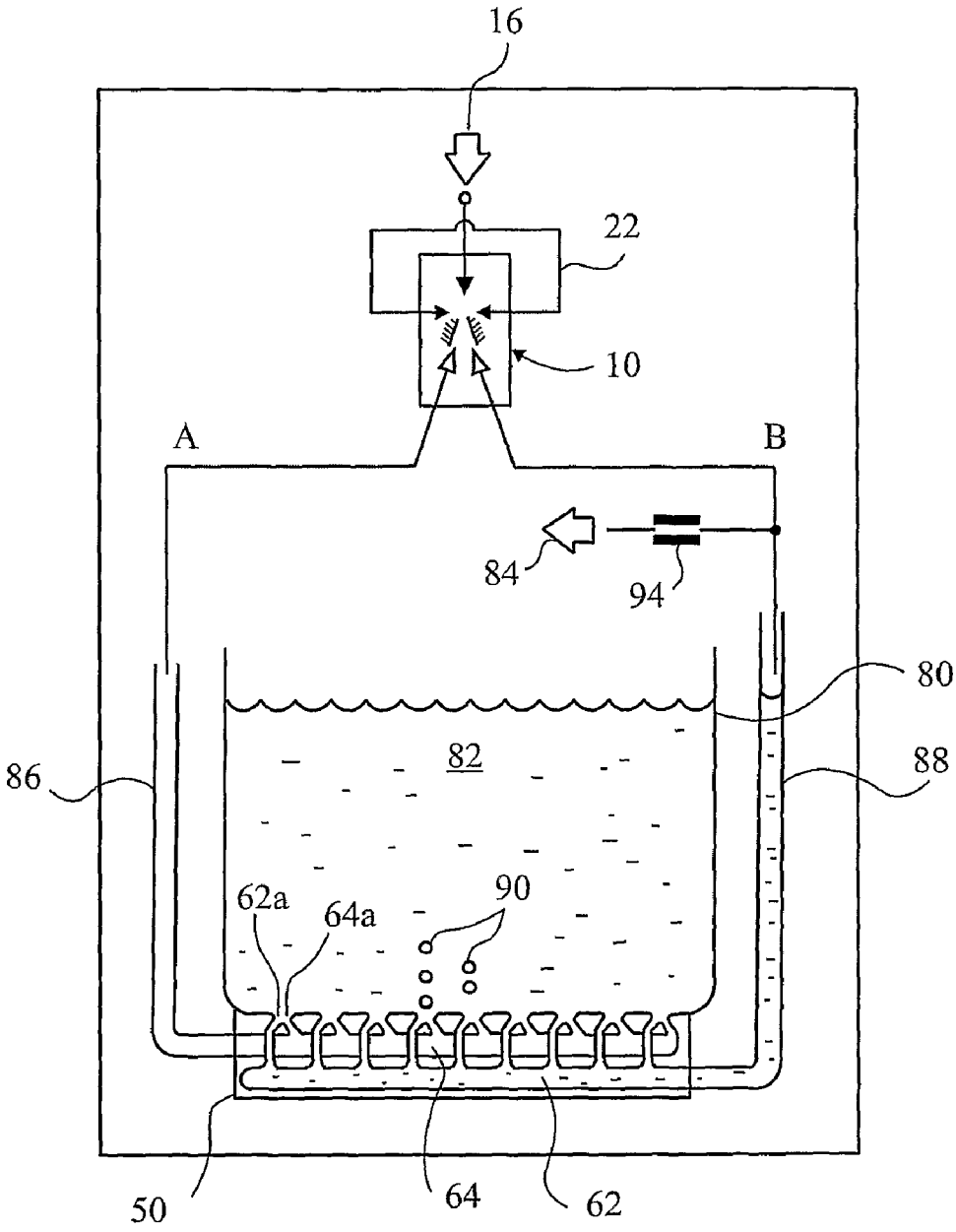
FIG. 6 is a schematic illustration of the overall arrangement employing the bubble plate of FIGS. 4 and 5.

Turning to FIG. 6, a tank 80 of liquid 82 has a diffuser 50 in its base. A gas supply 16 supplies gas under pressure to a diverter 10 of the kind shown in FIG. 1, and whose two outputs A,B are connected to passages 64,62 respectively by lines 86,88 respectively. However, while outlet connection A and line 86 are closed, connection B has a bleed 84 to the environment above tank 80, so that its pressure is substantially ambient. Consequently, line 88 fills with liquid to the height of the liquid in the tank 80. Indeed, when the air supply 16 is turned off, so does the outlet A and consequently the diverter 10 is located above the level of the liquid in the tank.

However, when the air supply 16 is turned on the pressure in branch A grows, albeit oscillatingly, to half the supply pressure, and this is arranged to be greater than the hydrostatic pressure at the bottom of the tank 80 so that air ultimately passes along the passage 64 and exits the ports 64*a* forming bubbles 90 in the liquid 82. When a pulse of pressure arrives in outlet B, the level of liquid in the line 88 drops, since the bleed 84 is controlled by a valve 94 transmitting the pressure pulse into a flow of liquid into the passage 62 and out of respective ports 62*a*. However, when the diverter switches flow back to outlet A, the hydrostatic pressure in the tank 82 returns the liquid through ports 62*a* refilling the line 88. Whether the line 88 is refilled entirely, so that the pressure outlet 88 is ambient by the time flow is switched again to outlet B is purely a design matter. It can be arranged that only when the pressure in the line 88 is substantially at the hydrostatic pressure near the bottom of the tank 80 is there sufficient pressure in the line 88 to bleed enough gas through the valve 94. In any event, the liquid level in the line 88 must be arranged at some point between the top and bottom of the tanks, and to oscillate above and below that level as gas supply is switched to and from the output B.

The ports 62*a* are larger simply because of the increased resistance of the liquid to flow, but also because a large flow pulse, rather than a narrow flow jet, is better at knocking off bubbles.

The back pressure regime in outputs A,B is arranged such that it does not adversely interfere with the oscillation of diverter 10, and each pulse into output A is arranged such that a hemispherical bubble forms at the mouth of each port 64*a*. When the pulse switches to output B, a jet of water issues from the mouth of each port 62*a* and is directed against the side of the bubble on the ports 64*a* and knocks them off. The bubbles 90 so formed are therefore very small, or at least much smaller than they would otherwise be, and of very even size distribution.

When the arrangement described above is employed with a liquid of relatively low viscosity such as water, it works very well. However, when it is employed with more viscous liquids, such as oil, a different mechanism is observed which gives rise to an alternative arrangement of the present invention (shown in FIG. 9 and described further below) and possibly an alternative explanation as to why the oscillation of the gas in a retrofit situation described with reference to FIGS. 7 and 8 may work, or indeed how the arrangement described with reference to FIGS. 4 to 6 may be working.

Figure 9:
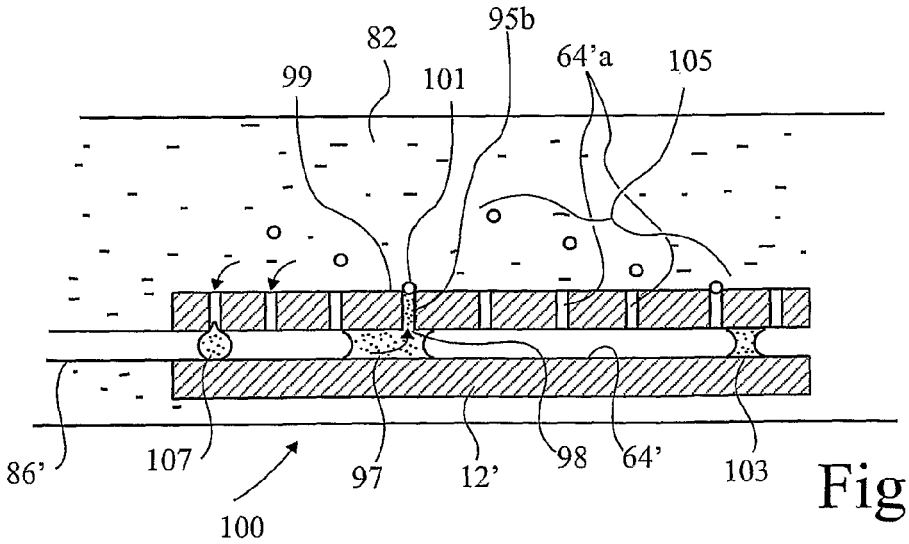
FIG. 9 is a section through a bubble generator according to the fourth aspect of the present invention.

FIG. 9 illustrates a bubble generator 1000, in which a plate 12' has a conduit 64' having a plurality of ports 64*a*' connecting the conduit 64 with the liquid 82 in which bubbles are to be formed. The conduit 64' is connected via tube 86' to a source of gas under pressure greater than the pressure of the liquid in the ports 64*a*', so that there is a net flow of gas along the conduit 64'. However, at the same time, the gas is also oscillating by virtue of a fluidic mechanism (not shown in FIG. 9) such as the diverter 10 of FIG. 1.

With high viscosity liquids such as motor oil as the liquid 82, the oscillations can be seen to permit introduction of some of the liquid into the conduit 64' through some of the ports 95. The exact mechanism is not yet explained, although could be through the venturi effect of high flow of gas periodically through the conduit 64' drawing liquid through certain of the ports (eg ports 95*a*), or it may be due to the low pressure phase of the oscillations and the relatively higher pressure in the liquid at this point in the gas pressure cycle. In any event, despite there being a net flow of gas through the conduit 64' and out of the ports 64*a*', nevertheless, plugs 97 of liquid appear in the conduit and progress along it, driven by the net flow of gas. As they travel along the conduit, they progressively close off mouths 98 of the ports (eg port 95*b*) and liquid enters the ports behind the gas already in the port. When the plug liquid contacts the main body of liquid 82 at the open end 99 of the port, the gas/liquid interface in the port completes the gas/liquid interface of bubble 101 presently being formed by the gas. Consequently it is easily detached from the port 95*b* and released into the liquid body 82.

With this mechanism, an inclined series of bubbles rise from the ports 64*a*'; and possibly several such streams, if several plugs 97 form (as shown for example at 103 where the plug is almost exhausted having pushed off a series of bubbles 105 and losing some of its volume to the main body of liquid 82). Also a new plug 107 is shown being drawn into the conduit 64'.

If such a mechanism is working with lower viscosity systems, (where the mechanism is more difficult to observe by virtue inter alia of the greater frequency of operation of such systems), then the above described mode of operation of the knock off system shown in FIGS. 4 to 6 may not be complete, or even entirely correct. However, the skilled person can find an arrangement that suits the particular requirements of a given application. Indeed, if the theory described above with reference to FIG. 9 is correct, it may explain why the oscillating gas produces fine bubbles. They may be produced not because the of the oscillations per se causing inertial movements of the liquid that pull off bubbles from the open end of the exit ports, as described above and pinching the bubbles off, but rather that plugs of liquid get entrained into the system and push off bubbles from behind.

Figure 10A:
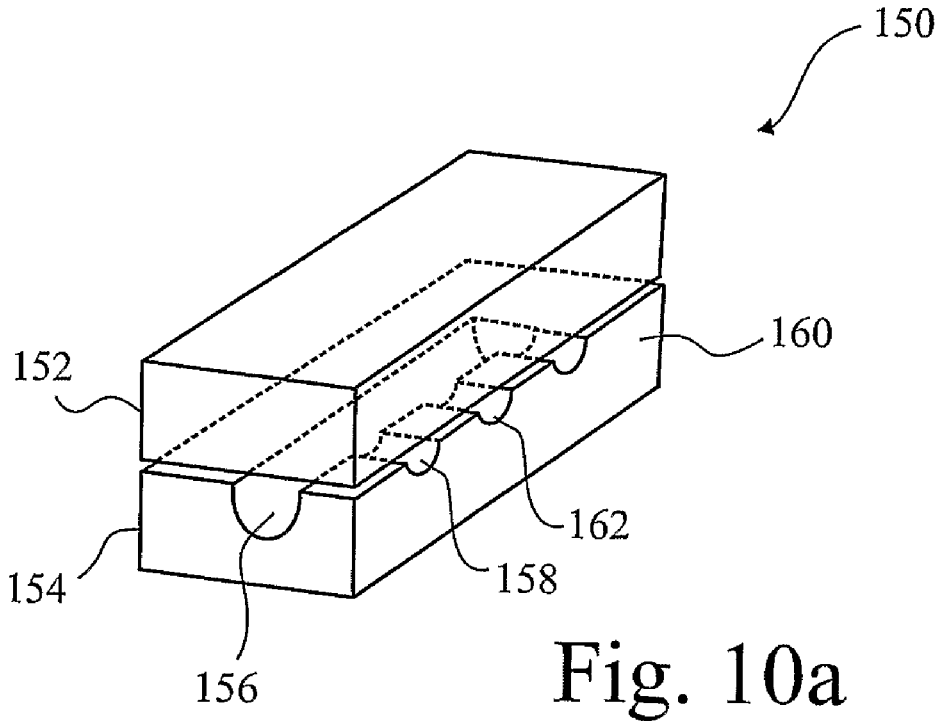
FIGS. 10 *a* and b are respectively a schematic perspective view of a diffuser employed in a method according to the present invention and a side section showing bubble pinch-off.
Figure 10B:
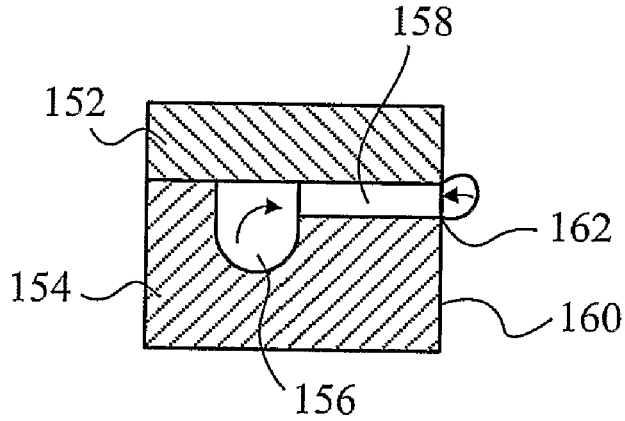

In FIG. 10, a glass diffuser 150 is constructed from two sheets of glass 152,154 adhered face to face, in which, on one sheet 154, channels 156,158 have been etched, so that, when connected as shown, a large conduit 156 is formed from which several smaller conduits 158 depend and emerge at surface 160 of the diffuser 150. In use, when connected to one branch of a diverter (such as that shown in, and described above with reference to, FIG. 1), bubbles are formed at the openings 162 of each conduit 158. If the channels 158 are approximately 60 microns in depth and width, bubbles of a corresponding diameter are pressed from the conduits 158. If the gas flow is oscillated as described above, bubbles of that size break off. However, if the face 160 is rendered horizontal, it is, in fact, possible for bubbles much larger than that to be formed, circ 500 microns diameter, with surface tension managing to adhere the bubble to the opening and it merely growing, albeit oscillatingly, until finally the mass of liquid displaced detaches the bubble. However, when the face 160 is oriented vertically, as shown in FIGS. 10*a,b*, the rebounding bubble in the first or second oscillation does not fit squarely against the opening but is distorted upwardly by gravity, and this results in the bubble pinching off much sooner. This is particularly the case if the material of the diffuser 150 is non-sticky, as far as the gas, is concerned, and this is the case for glass where the gas is air. Likewise for non-stick materials such as Teflon®. Thus, with nothing else, bubbles of the order of 50 to 100 microns can be produced.

Figure 11A:
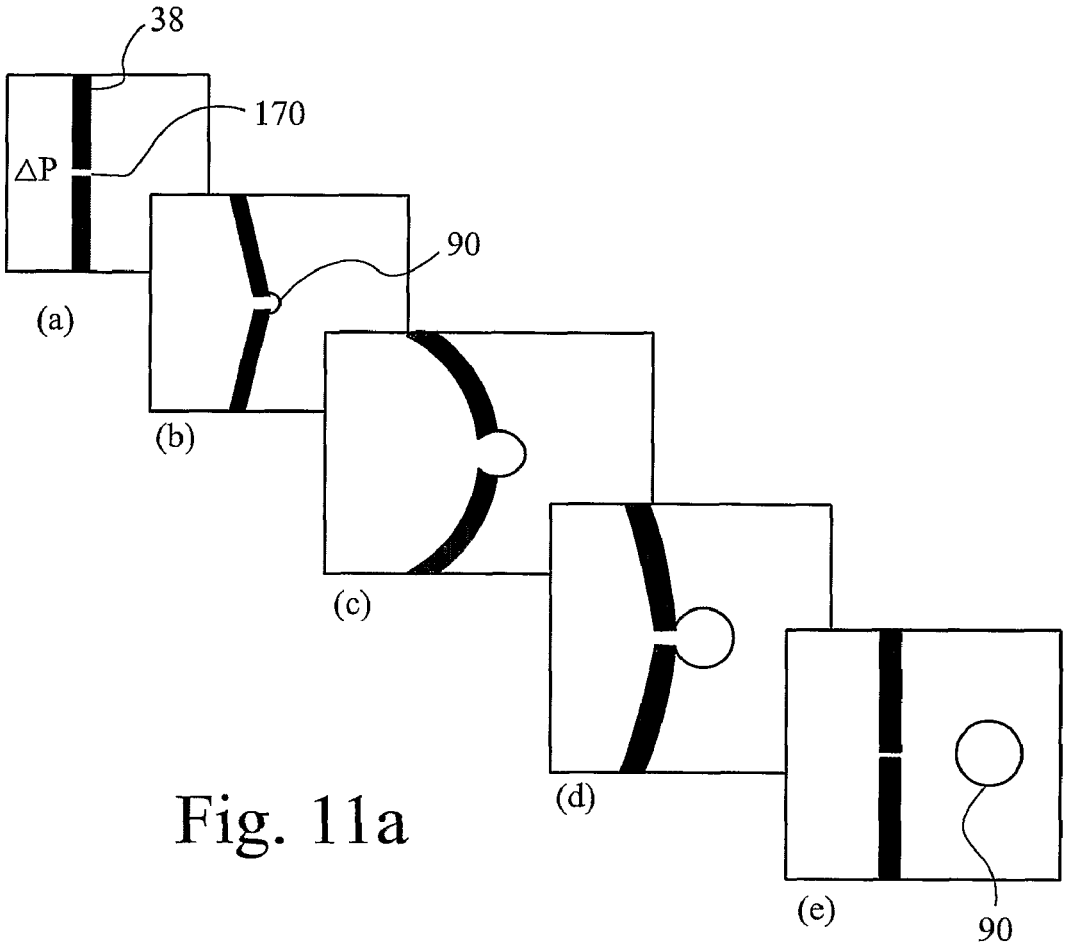
FIGS. 11 *a* and b are respectively side sections, (a) to (e), through an elastic membrane showing the development of a bubble, and a graph of differential gas/liquid pressure ΔP across the membrane at each of the stages of bubble formation shown in FIG. 11*a*.

Turning to FIG. 11, some existing diffusers employed in waste water cleaning, such as those illustrated in FIGS. 7 and 8, have a membrane (38, in FIG. 8 and in FIG. 11*a*) which has a number of slits cut through it. The mode of operation is already oscillatory to some extent, even with a steady gas flow, as the pressure distends the membrane, opens the slits and, as bubbles pinch off, there is a certain rebound of the lips of the slit before a new bubble begins. However, with reference to FIG. 11*a* and an oscillating gas pressure, the differential pressure $\Delta P$ across a slit 170 increases from zero as shown at (a). In (b), the gas begins to deform the membrane 38 and it is forced through the slit commencing the formation of a bubble 90. As the pressure continues to increase, the membrane deforms further, as shown in (c) accelerating the growth of the bubble. However, at this point the pressure differential begins to decrease so that the natural rebound of the elastic membrane is facilitated, closing off the bubble 90 as shown at (d). Finally, with zero pressure the membrane returns to the position shown at (a), and (e) but in the latter with the bubble 90 released.

Figure 11B:
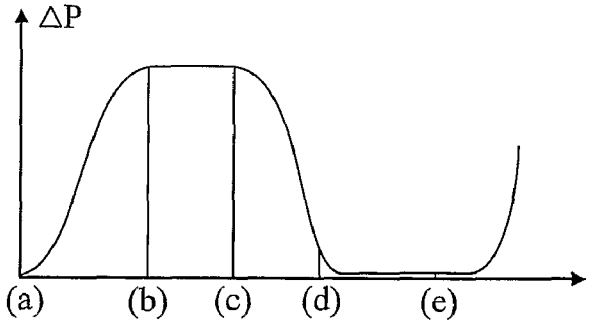

By matching the oscillation of the gas flow to the elastic resonance of the membrane the formation of small bubbles is possible with little energy expenditure. FIG. 11*b* shows a preferred form of square wave pressure development that is potentially the result of both the fluidic arrangement and slitted membrane, and shows the potential pressure positions at each stage of bubble development illustrated in FIG. 11*a*.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A method of producing small bubbles of gas in a liquid comprising the steps of:
   - providing a source of the gas under pressure;
   - providing a conduit opening into a liquid under pressure less than said gas, said gas being in said conduit; and
   - oscillating the gas passing along said conduit without oscillating the conduit, other than by any reaction of the oscillating gas, said oscillation being effected by a fluidic oscillator,
   - wherein said oscillation effected by the fluidic oscillator is of the type that has between 10 and 30% backflow of gas from an emerging bubble.

2. A method as claimed in claim 1, wherein said oscillations effected by the fluidic oscillator are at a frequency between 1 and 100 Hz.

3. A method as claimed in claim 1, in which the fluidic oscillator comprises an arrangement in which gas flow is oscillated between two paths, at least one of said paths forming said source.

4. A method as claimed in claim 3, in which said oscillator comprises a diverter supplied with the gas under constant pressure through a supply port that divides into respective output ports, and including means to oscillate flow from one output port to the other.

5. A method as claimed in claim 4, wherein said means comprises each output port being controlled by respective control ports.

6. A method as claimed in claim 5, wherein the control ports are interconnected by a closed loop and are arranged so that each has reduced pressure when the gas flows through its respective output and increased pressure when there is no flow through its respective output, and so that, when gas flows out of a control port into its respective output port, flow of the gas is switched from that output port to the other, whereby the flow into the supply port oscillates between said output ports.

7. A method as claimed in claim 6, wherein the frequency of the oscillations may be adjusted by changing the length of said closed loop.

8. A method as claimed in claim 7, wherein a branch of each output port supplies the respective control port, whereby part of the flow in an output port becomes a control flow, switching the supply flow from that output port to the other output port.

9. A method as claimed in claim 4, in which there are at least two of said conduits, each output port being connected to one or the other of said conduits.

10. A method as claimed in claim 1, in which the conduit opens in the liquid at a surface of the material in which the conduit is formed, said surface being in a plane which is substantially vertical with respect to gravity.

11. A method as claimed in claim 1, in which the material of the surface through which the conduit is formed is preferably non-wettable by the gas, so that the bubble does not tend to stick to it.

12. A method as claimed in claim 1, in which the volume flow of said oscillating gas is sufficient that a plurality of said conduits are supplied simultaneously, the volume flow rate for each cycle of oscillation being sufficient to fill a bubble at each conduit to at least hemispherical size before the oscillation is switched, so that all the bubbles have substantially the same size before being separated from the conduit by the break in pressure.

13. A method as claimed in claim 1, in which said conduit comprises a membrane having a normally closed slit, gas pressure behind the membrane serving to distend the membrane opening the slit to permit a bubble of gas to form through the slit, the slit closing behind the bubble, wherein the oscillation of the gas flow is synchronised in terms of pressure, flow rate, amplitude and frequency with the elastic properties of the membrane to encourage small bubble formation.

14. A method as claimed in claim 1, in which one phase of the oscillating gas is employed to drive liquid across the conduit after formation of a bubble in the other phase of oscillation, whereby the bubble is detached by the force of said driven liquid.

15. A method as claimed in claim 14, in which the conduits of each output are arranged facing one another at an inclined angle, preferably at right angles, with respect to one another, one output being maintained filled with the liquid.

16. A method as claimed in claim 15, in which, while the first output fills a bubble at the mouth of its conduit during a first phase of oscillation, on a second phase thereof, liquid is driven out of the other conduit, knocking off the bubble formed on the first conduit.

17. A method as claimed in claim 16, in which there are a plurality of conduits, being gas conduits, that are supplied in parallel from one output, and a similar plurality of conduits, being liquid conduits, that are disposed opposite the gas conduits and supplied in parallel by the other output.

18. A method of producing small bubbles of gas in a liquid comprising the steps of:

providing a source of the gas under pressure;

providing a conduit opening into a liquid under pressure less than said gas, said gas being in said conduit; and oscillating the gas passing along said conduit without oscillating the conduit, other than by any reaction of the oscillating gas, wherein:

said oscillation effected by the fluidic oscillator is at a frequency between 1 and 100 Hz; and said oscillation effected by the fluidic oscillator is of the type that has between 10 and 30% backflow of as from an emerging bubble.

19. A method as claimed in claim 18, in which the bubbles formed are between 0.1 and 2 mm in diameter.

20. A method as claimed in claim 18, in which the conduit opens in the liquid at a surface of the material in which the conduit is formed, said surface being in a plane which is substantially vertical with respect to gravity.

21. A method as claimed in claim 18, in which the bubbles formed are between 0.5 and 1.0 mm in diameter.

22. A method of producing small bubbles of gas in a liquid, comprising the steps of:

providing a source of the gas under pressure;

providing a conduit opening into a liquid under pressure less than said gas through a plurality of openings of the conduit, said openings having an open end and an end in contact with the conduit, said gas being in said conduit; and oscillating the gas passing along said conduit so that liquid is drawn into the conduit through at least one of said openings and forms a plug of liquid in the conduit pushed along said conduit by the gas so that, when said plug reaches others of said openings, the gas is pushed out of said openings by the liquid plug thereby forming a bubble when said plug reaches the open end of said openings.

* * * * *